US009199472B2

(12) United States Patent
Ishida et al.

(10) Patent No.: US 9,199,472 B2
(45) Date of Patent: Dec. 1, 2015

(54) LIQUID EJECTION APPARATUS, MIST COLLECTING MECHANISM AND MIST COLLECTION METHOD

(71) Applicant: CANON KABUSHIKI KAISHA, Tokyo (JP)

(72) Inventors: Koichi Ishida, Tokyo (JP); Hiroshi Arimizu, Kawasaki (JP); Arihito Miyakoshi, Tokyo (JP); Yoshinori Itoh, Tokyo (JP); Nobuhito Yamaguchi, Inagi (JP); Masahiko Kubota, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/484,447

(22) Filed: Sep. 12, 2014

(65) Prior Publication Data

US 2015/0085014 A1 Mar. 26, 2015

(30) Foreign Application Priority Data

Sep. 20, 2013 (JP) ..... 2013-195868
Jul. 31, 2014 (JP) ..... 2014-156659

(51) Int. Cl.
*B41J 2/165* (2006.01)
*B41J 2/17* (2006.01)

(52) U.S. Cl.
CPC ..... *B41J 2/1714* (2013.01)

(58) Field of Classification Search
None
See application file for complete search history.

(56) References Cited

U.S. PATENT DOCUMENTS 7,314,267 B2 1/2008 Yamaguchi et al.
8,075,120 B2 * 12/2011 Ide et al. ..... 347/92
8,262,192 B2 * 9/2012 Matsumoto ..... 347/25
8,356,881 B2 1/2013 Ohnishi

FOREIGN PATENT DOCUMENTS

JP 2010-137483 A 6/2010

* cited by examiner

*Primary Examiner* — Alejandro Valencia
(74) *Attorney, Agent, or Firm* — Fitzpatrick, Cella, Harper & Scinto

(57) ABSTRACT

There are provided a mist collecting mechanism capable of efficiently sucking and collecting an air blown out from a blow-out unit and a liquid ejection apparatus including the mist collecting mechanism. The mist collecting mechanism includes a suction port configured to suck an air containing mists. Moreover, the mist collecting mechanism includes a first blow-out port that blows out an air in order to guide the air containing mists to the suction port. Moreover, the mist collecting mechanism includes a second blow-out port that blows out an air in order to adjust a position, toward which the air blown out from the first blow-out port flows, so that the air blown out from the first blow-out port is appropriately sucked by the suction port.

8 Claims, 8 Drawing Sheets

LIQUID EJECTION APPARATUS, MIST COLLECTING MECHANISM AND MIST COLLECTION METHOD

BACKGROUND OF THE INVENTION

1. Field of the Invention

The present invention relates to a mist collecting mechanism for collecting mists that are generated in ejecting liquid, such as ink, from an ejection port, a liquid ejection apparatus including the mist collecting mechanism and a mist collection method.

2. Description of the Related Art

In a liquid ejection apparatus that performs printing by ejecting liquid, such as ink, when a main drop of ink is ejected, a satellite drop smaller than the main drop and/or a spray mist further smaller than the main drop may be generated together with the main drop of ink. The amount of generation of mists varies with the ink properties, such as the viscosity and surface tension of ink, and/or the surrounding environment factors, such as temperature and humidity. The mist is minuscule and susceptible to air resistance. Accordingly, some of the mists float around the liquid ejection apparatus without adhering to the surface of a printing medium. Moreover, the mist is susceptible to an air current because the mass thereof is small. In a case where this mist adheres to a surface, in which an ejection port is formed, in a liquid ejection head, an ejection failure that the landing accuracy of ink decreases due to this adhesion may occur. Moreover, the mist may adhere to other components of the liquid ejection apparatus, which may cause reduction in durability of the liquid ejection apparatus.

In order to suppress the influence on the liquid ejection apparatus from such mists, Japanese Patent Laid-Open No. 2010-137483 discloses a mist collecting mechanism for sucking and collecting mists.

In the mist collecting mechanism for collecting mists disclosed in Japanese Patent Laid-Open No. 2010-137483, an air is once sprayed toward a printing medium by the blowing-out from a blow-out unit, and then an air current reflected by the printing medium is sucked by a suction unit. At this time, the air reflected by the printing medium is sucked and at the same time the mist contained in the air reflected by the printing medium is also collected by the mist collecting mechanism all together. Thus, the mist around the mist collecting mechanism is sucked and collected.

However, in the mist collecting mechanism disclosed in Japanese Patent Laid-Open No. 2010-137483, the accuracy in guiding the blown-out air current to a predetermined suction position of the suction unit is insufficient. Therefore, the air blown out from the blow-out unit might not be precisely supplied to the suction position in the suction unit and the mist might not be efficiently sucked by the suction unit.

SUMMARY OF THE INVENTION

The present invention has been made in view of the above circumstances and aims at providing a mist collecting mechanism capable of efficiently sucking and collecting an air blown out from a blow-out unit with high accuracy, a liquid ejection apparatus including the mist collecting mechanism and a mist collection method.

According to the present invention, a liquid ejection apparatus comprising: a liquid ejection head configured to eject liquid; and a mist collecting mechanism configured to collect mists that are generated when the liquid is ejected from the liquid ejection head, wherein the mist collecting mechanism includes: a suction port configured to suck an air containing mists; a first blow-out port that blows out an air in order to guide the air containing mists to the suction port; and a second blow-out port that blows out an air in order to adjust a position, toward which the air blown out from the first blow-out port flows, so that the air blown out from the first blow-out port is sucked by the suction port.

According to the present invention, a mist collecting mechanism configured to collect mists that are generated when liquid is ejected from a liquid ejection head that performs printing by ejecting the liquid, the mist collecting mechanism comprising: a suction port configured to suck an air containing mists; a first blow-out port that blows out an air in order to guide the air containing mists to the suction port; and a second blow-out port that blows out an air in order to adjust a position, toward which the air blown out from the first blow-out port flows, so that the air blown out from the first blow-out port is appropriately sucked by the suction port.

According to the present invention, a liquid ejection apparatus comprising a liquid ejection head having an ejection port array, in which ejection ports configured to eject liquid are arranged in a predetermined direction, the liquid ejection apparatus applying the liquid ejected from the ejection port to a printing medium, the liquid ejection apparatus further comprising: a first blow-out port configured to blow out an air toward the printing medium; a suction port configured to suck an air containing mists that are generated when the liquid is ejected from the ejection port; and a second blow-out port configured to blow out an air toward the printing medium, wherein the ejection port array, the second blow-out port, the suction port, and the first blow-out port are arranged in this order from an upstream side toward a downstream side with respect to a relative movement direction between the liquid ejection head and the printing medium.

According to the present invention, a mist collection method configured to collect mists that are ejected along with a droplet ejected from an ejection port configured to eject liquid, the method comprising the steps of: providing a liquid ejection apparatus including: an ejection port array in which ejection ports configured to eject liquid are arranged in array; a first blow-out port configured to blow out an air toward a printing medium; a suction port configured to suck an air; and a second blow-out port configured to blow out an air toward the printing medium, wherein the ejection port array, the second blow-out port, the suction port, and the first blow-out port are arranged in this order in parallel; and ejecting liquid from the ejection port, and sucking the mists, which were ejected from the ejection port, from the suction port by sucking an air from the suction port, and by blowing out a specified amount of air from the first blow-out port, and by blowing out an amount of air smaller than the specified amount from the second blow-out port.

According to the present invention, the mist around a liquid ejection apparatus can be efficiently collected, so the environment around the liquid ejection apparatus can be kept clean. Accordingly, the adhesion of the mist to each part of the liquid ejection apparatus can be suppressed, and the influence on the liquid ejection apparatus due to the adhesion of the mist can be suppressed. Moreover, a decrease in the quality of a printing image due to the adhesion of the mist to a printing medium can be suppressed.

Further features of the present invention will become apparent from the following description of exemplary embodiments (with reference to the attached drawings).

BRIEF DESCRIPTION OF THE DRAWINGS

FIGS. 7A and 7B are enlarged cross sectional views schematically illustrating the main portion of a liquid ejection head and mist collecting mechanism used for a liquid ejection apparatus according to a third embodiment of the present invention, in which FIG. 7A illustrates scanning in one direction and FIG. 7B illustrates scanning in the opposite direction.

DESCRIPTION OF THE EMBODIMENTS

Hereinafter, specific embodiments of the present invention will be described in detail with reference to the accompanying drawings.

First Embodiment

Figure 1:
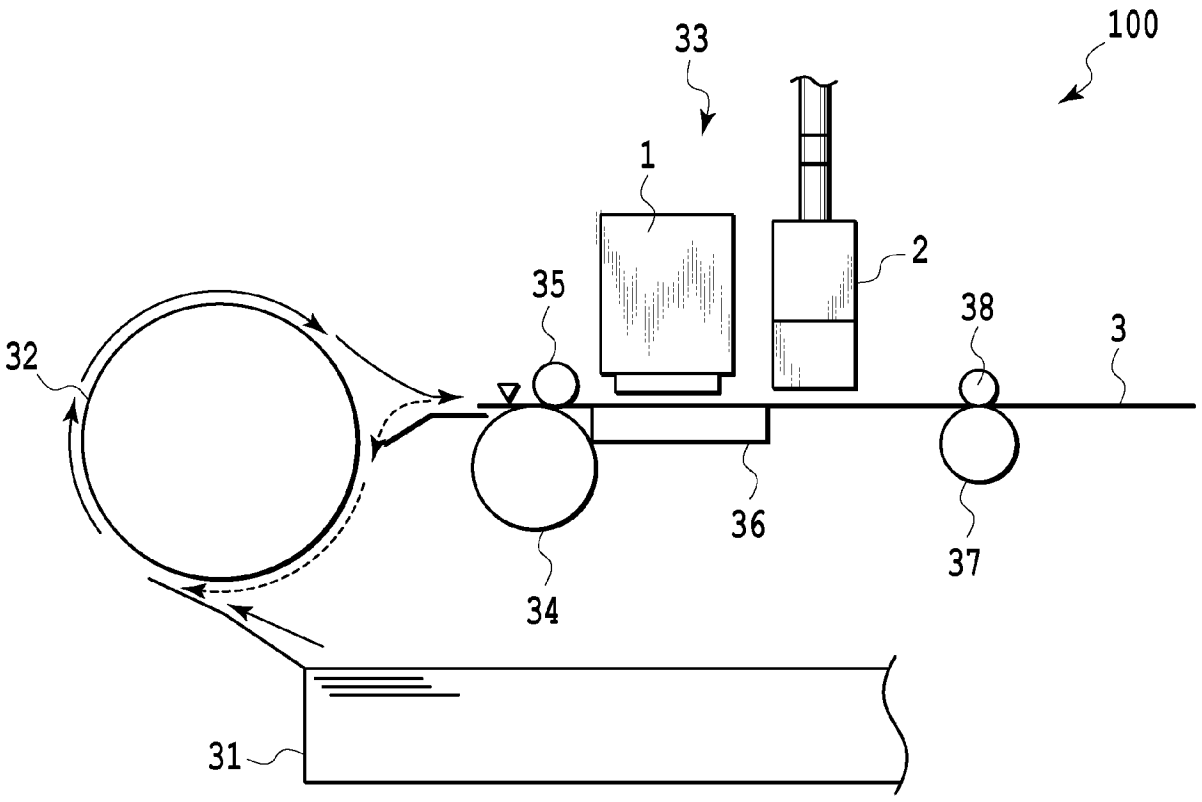
FIG. 1 is a side view schematically illustrating the configuration of a liquid ejection apparatus according to a first embodiment of the present invention.
Figure 2:
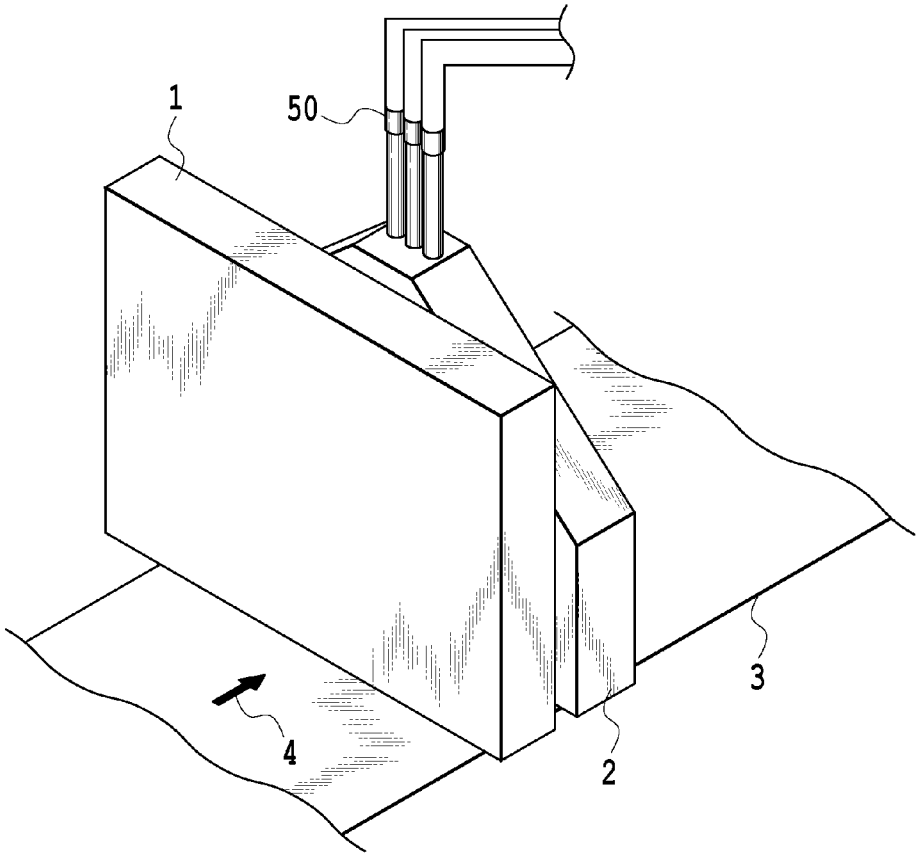
FIG. 2 is an enlarged perspective view illustrating the periphery of a liquid ejection head and a mist collecting mechanism in the liquid ejection apparatus of FIG. 1.

FIG. 1 illustrates a schematic cross sectional view of a liquid ejection apparatus 100 according to a first embodiment of the present invention. FIG. 1 is a side view of the liquid ejection apparatus 100 as seen from a side face thereof. Moreover, FIG. 2 illustrates an enlarged perspective view illustrating a peripheral portion of a printing unit 33 in the liquid ejection apparatus 100.

The liquid ejection apparatus 100 includes a paper feed cassette 31, a U-turn conveying unit 32, a printing unit, and a mist collecting mechanism 2. In a state before printing is performed, a printing medium 3 is stored and stacked inside the paper feed cassette 31. The U-turn conveying unit 32 is arranged on the downstream side in the conveying direction of the printing medium of the paper feed cassette 31. The U-turn conveying unit 32 also has the function as a duplex inversion unit. Hereinafter, the conveying direction of the printing medium is simply referred to as the conveying direction. Moreover, the upstream side direction and downstream side direction in the conveying direction of the printing medium are simply referred to as the upstream side and the downstream side.

On the downstream side of the U-turn conveying unit 32, a printing unit 33 is arranged in which the printing is performed on the printing medium. The printing unit 33 includes a liquid ejection head 1 that ejects liquid, such as ink. Moreover, on the upstream side of the liquid ejection head 1 in the printing unit 33, a conveyor roller 34 and a pinch roller are arranged. A platen 36 is arranged at a position corresponding to the liquid ejection head 1 in the printing unit 33. The platen 36 supports, during printing, the printing medium that is conveyed to the position corresponding to the liquid ejection head 1. A discharge roller 37 and a pinch roller 38 are arranged on the downstream side of the printing unit 33. The discharge roller 37 and the pinch roller 38 discharge the printing medium 3, on which the printing is performed by the liquid ejection head 1, to a discharge position.

Figure 3A:
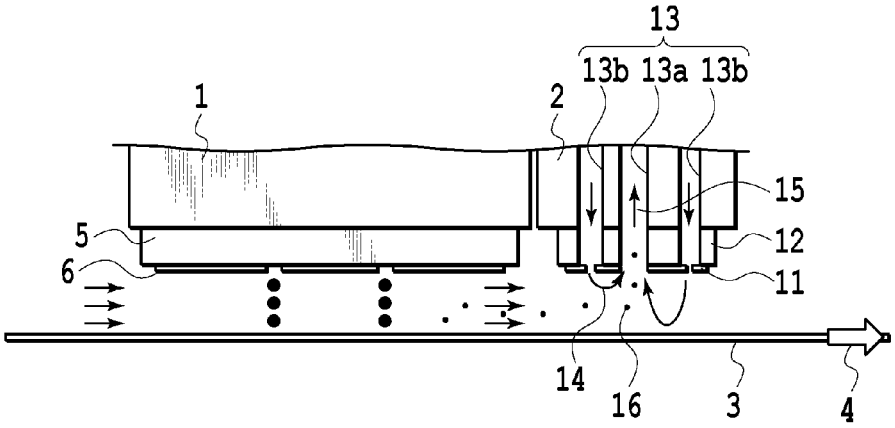
FIG. 3A is an enlarged cross sectional view schematically illustrating the main portion in the liquid ejection head and the mist collecting mechanism of FIG. 1.
Figure 3B:
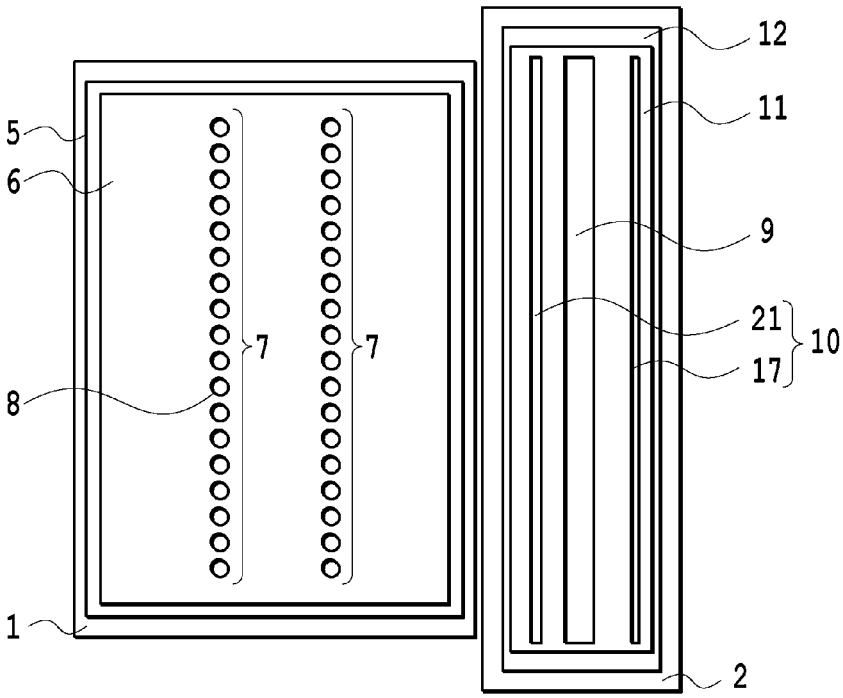
FIG. 3B is a plan view schematically illustrating the liquid ejection head and the mist collecting mechanism of FIG. 3A as seen from a printing medium side.

FIG. 3A illustrates a schematic cross sectional view of the periphery of the printing unit 33 including the liquid ejection head 1 and the mist collecting mechanism 2 as seen from the side thereof. Moreover, FIG. 3B illustrates a schematic plan view of the periphery of the printing unit 33 including the liquid ejection head 1 and the mist collecting mechanism 2 as seen from the side of the printing medium.

In the liquid ejection head 1 of the present embodiment, ink is supplied to the liquid ejection head 1 from a non-illustrated ink tank and the ink is stored inside the liquid ejection head 1. The liquid ejection head 1 is formed by an element substrate 5 including energy generating element configured to generate energy used for ejecting liquid being bonded with an orifice member 6, on a support member. In the orifice member 6, a plurality of ejection ports 8 are arranged in a row in a predetermined direction to form a plurality of ejection port arrays 7. In the present embodiment, two rows of ejection port arrays 7 are formed in the orifice member 6. The ejection port arrays 7 formed in the liquid ejection head 1 are arranged side by side in a direction crossing the conveying direction of the printing medium 3. In this embodiment, the ejection ports 8 are arranged along the direction crossing to the conveying direction of the printing medium 3 to form the ejection port array 7.

In the liquid ejection head 1 of the present embodiment, the ejection ports 8 constituting the ejection port array 7 are formed in the orifice member 6. In the orifice member 6, a non-illustrated ink channel is formed so that the ink stored in the liquid ejection head 1 is supplied to each of the ejection ports 8. The liquid ejection head 1 ejects ink supplied from the non-illustrated ink tank and stored in the liquid ejection head 1 once, through the ejection port 8. In the element substrate 5, an ink supply port, that is a through-hole, is formed so as to communicate with the ink channel formed in the orifice member 6 and supply the ink to the ink channel. The ink supplied to the ink supply port is once stored in the ink channel.

In this embodiment, the ink channel formed inside the orifice member 6 includes a heat generating resistance element (electrothermal transducer) that is the energy generating element. A thermal energy is generated from the heat generating resistance element by electrifying the heat generating resistance element through wirings. Thereby the ink inside the ink channel is heated and foams due to film boiling. An ink droplet is ejected from the ejection port 8 due to this foaming energy.

Note that, in the liquid ejection head 1 of the present embodiment, film boiling is caused by the heat generating resistance element so as to cause the ink to foam and eject the ink droplet, but the present invention is not limited thereto. Such a type of liquid ejection head that ejects liquid inside the liquid ejection head by deforming a piezoelectric element may be applied to the printing apparatus, or another type of liquid ejection head may be applied to the printing apparatus of the present invention. Moreover, whichever an ink tank mounted on the liquid ejection head or an ink tank incorporated into the printing apparatus body may be used.

The liquid ejection apparatus 100 of the present embodiment is a full-line type printing apparatus using a liquid ejection head that extends across the whole region in the width direction of the printing medium 3. The liquid ejection head 1 is mounted on a carriage fixed to a printing position.

Once printing is started, the printing medium 3 stored in the paper feed cassette 31 is picked up one by one by a non-illustrated feed roller and a separating unit, and is sequentially conveyed toward the printing position. The printing medium is conveyed on the U-turn conveying unit 32 in an arrow direction indicated by a solid line. Once the printing medium 3 fed along the arrow indicated by the solid line reaches the conveyor roller 34 and the pinch roller 35, the printing medium 3 is conveyed along the conveying direction by the conveyor roller 34 being driven to rotate in a state where the printing medium 3 is sandwiched between the conveyor roller 34 and the pinch roller 35. Once the printing medium reaches the position corresponding to the liquid ejection head 1 in the printing unit 33, ink is ejected from the liquid ejection head 1 toward the surface of the printing medium 3 and thereby the ink is applied to the printing medium 3 and a printing image is printed. In a case of single-sided printing wherein printing is performed only onto one side of the printing medium 3, once the printing onto the printing medium 3 is performed, the printing medium 3 is discharged to the discharge position through the discharge roller 37 and the pinch roller 38.

When printing is performed onto the both sides of the printing medium 3 which is fed along the arrow indicated by the solid line, the rollers are once stopped and the conveyance of the printing medium 3 is stopped. Then, the conveyor roller 34 is reversely rotated and the printing medium 3 is conveyed in a direction opposite to the conveying direction. Once the back end of the printing medium 3 passes between the conveyor roller 34 and the pinch rollers 35, the printing medium 3 is conveyed along a path indicated by a dotted line in the U-turn conveying unit 32. The printing medium 3 returns to the conveying path of the printing medium 3 in a state where the front and back sides thereof are reversed from those in the case where printing is started. The printing medium 3 is conveyed in this state along the conveying path indicated by the solid line, and thus the printing medium 3 passes between the conveyor roller 34 and the pinch roller 35 again in a state where the back side thereof faces the liquid ejection head 1. Once the printing medium 3 is conveyed to the position corresponding to the liquid ejection head 1, ink is ejected onto the back side of the printing medium 3 by the liquid ejection head 1 and thereby printing onto the back side of the printing medium 3 is performed.

Between the U-turn conveying unit 32 and the conveyor roller 34 as well as the pinch roller 35, a non-illustrated flapper for switching and restricting the travelling direction of the printing medium 3 is arranged. Accordingly, in the case where the printing medium is conveyed in the arrow direction indicated by the dotted line, the conveying direction of the printing medium is switched by the flapper.

Moreover, the mist collecting mechanism 2 capable of collecting mists is arranged in the liquid ejection apparatus 100 of the present embodiment. The mist collecting mechanism 2 is arranged on the downstream side in the conveying direction of the liquid ejection head 1. At a position on the downstream side of the liquid ejection head 1, the mist that flows from the liquid ejection head 1 to the downstream side is sucked and collected.

The configuration of the mist collecting mechanism 2 is described with reference to FIGS. 3A and 3B. In the mist collecting mechanism 2, the suction port 9 which is opened in an elongated shape so as to have a long side extending along a direction substantially parallel to the ejection port array 7, and for sucking the air containing mists, is formed. The suction port 9 is formed extending in a direction crossing to the conveying direction of the printing medium 3. On the upstream side and downstream side in the conveying direction of the suction port 9, two blow-out ports 10 are formed in parallel with the suction port 9 so as to sandwich the suction port 9. The blow-out port 10 includes a first blow-out port 17 arranged at downstream side of the suction port 9, that blows out an air in order to guide the air containing mists to the suction port 9. Moreover, the blow-out port 10 includes a second blow-out port 21 arranged at upstream side of the suction port 9, that blows out an air for adjusting a position, toward which the air blown out from the first blow-out port 17 flows, so that the air blown out from the first blow-out port 17 is appropriately sucked by the suction port 9. In the present embodiment, the blow-out port 10 is opened in an elongated shape so as to have the long side extending along the direction crossing to the conveying direction of the printing medium. Each of the blow-out ports 10 is configured to be able to blow out air. A duct 13 through which air passes is formed inside the mist collecting mechanism 2. With regard to the positional relationship between these components, the ejection port array 7, the second blow-out port 21, the suction port 9, and the first blow-out port 17 are arranged in this order from the upstream side toward the downstream side with respect to the relative movement direction between the liquid ejection head 1 and the printing medium. The second blow-out port 21, the suction port 9, and the first blow-out port 17 extend along a predetermined direction to which the ejection port arrays 7 arranged in array extend. The ejection port array 7, the second blow-out port 21, the suction port 9, and the first blow-out port 17 are arranged in parallel to a direction crossing to the predetermined direction along which the ejection port arrays 7 are arranged in array.

In the present embodiment, the blowing-out of air from the first blow-out port 17 and the second blow-out port 21 and the sucking of air from the suction port 9 are performed by a blowing mechanism, such as a fan or a pump, provided in the mist suction mechanism 2 or the liquid ejection apparatus.

The size of an opening in the blow-out port 10 is defined by a slit member 11. The slit member 11 is attached at a position facing the printing medium in the mist collecting mechanism 2. A sucking slit for passing the air that is sucked to the suction port 9 and a plurality of blowing-out slits for passing the air that are blown out from the blow-out port 10 are formed in the slit member 11. The sucking slit formed at a position corresponding to the suction port 9 in the slit member 11 is formed so as to have a size substantially matching the size of a suction duct for passing the air that is sucked from the suction port 9, the suction duct being formed inside the mist collecting mechanism 2. Moreover, as shown in FIG. 3B, the length in the predetermined direction, along which the ejection port arrays 7 are arranged, in each of the second blow-out port 21, the suction port 9, and the first blow-out port 17 is formed longer than the length in the predetermined direction of the ejection port array 7. Moreover, the blowing-out slit formed at a position corresponding to the blow-out port 10 in the slit member 11 is formed smaller than a blowing-out duct 13*b* that is formed inside the mist collecting mechanism 2 and supplies air to the blow-out port 10. The length of the blowing-out slit in the direction along the relative movement between the mist collecting mechanism 2 and the printing medium is smaller than the length of the blowing-out duct 13*b*. Thus, in the blow-out port 10, the size of the opening of the blow-out port 10 is defined by the blowing-out slit formed in the slit member 11.

In the mist collecting mechanism 2, the slit member 11 is attached to a support member 12 which is attached to the main body of the mist collecting mechanism 2. As described above, in this embodiment, the slit member 11 is supported by the support member 12 attached to the main body. Moreover, in the inside of the support member 12, a sucking duct 13*a* for passing the air that is sucked from the suction port 9 and the blowing-out duct 13*b* for passing the air that is blown out from the blow-out port 10 are formed therein. Moreover, in the mist collecting mechanism 2, a non-illustrated air suction mechanism and a non-illustrated air blow-out mechanism are arranged. To the air suction mechanism, the sucking duct 13*a* is connected so as to communicate with the suction port 9. Moreover, to the air blow-out mechanism, the blowing-out duct 13*b* is connected so as to communicate with the blow-out port 10.

The mist collecting mechanism 2 is connected to a non-illustrated air current generation mechanism for generating an air current by blowing out air into between the mist collecting mechanism 2 and the printing medium 3. This air current generation mechanism and the mist collecting mechanism 2 are connected via an air flow path 50, as shown in the FIG. 2.

When the printing medium is conveyed, the printing medium is conveyed by driving of the conveyor roller and a belt. The liquid ejection apparatus performs printing by repeating a printing operation of ejecting ink toward a printing area of the printing medium 3 while moving the printing medium 3 along the conveying direction 4.

In printing, a satellite drop smaller than the main drop and a mist smaller than the satellite drop are generated simultaneously with ejection of the main drop of ink. The mist generated in this case cannot reach to printing medium 3 and will float around the liquid ejection head 1 because the size and mass thereof is fairly small as compared with the main drop of ink. Moreover, because the mass of the mist is small, the mist is susceptible to an air current. Therefore, once an air current is generated around the liquid ejection head 1, the mist tends to move riding on the air current.

In the present embodiment, because printing is performed by the full-line type liquid ejection apparatus 100, the printing medium relatively moves along the conveying direction with respect to the liquid ejection head 1 during printing. At this time, the printing medium 3 pulls the air present between the liquid ejection head 1 and the printing medium 3 to the conveying direction. Therefore, in the space between the liquid ejection head 1 and the printing medium 3, an air current is generated from the upstream side toward the downstream side along the conveying direction of the printing medium 3. Accordingly, the mist generated in printing rides on the air current and moves to the downstream side of the liquid ejection head 1 along the conveying direction of the printing medium 3 as the printing medium 3 is conveyed.

The mist generated in printing is collected by the mist collecting mechanism. 2 provided on the downstream side of the liquid ejection head 1. Hereinafter, the collection of the mist by the mist collecting mechanism 2 is described.

Figure 4A:
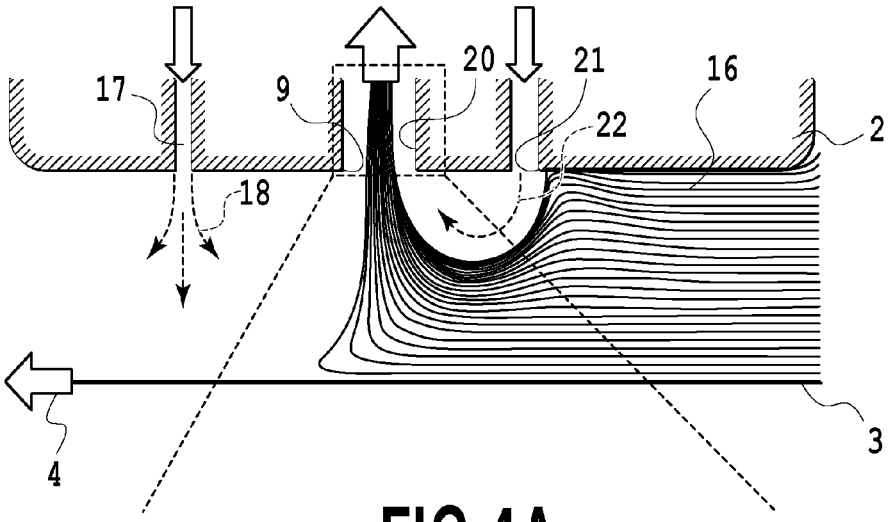
FIG. 4A is an explanatory view for illustrating an air current around the mist collecting mechanism.
Figure 4B:
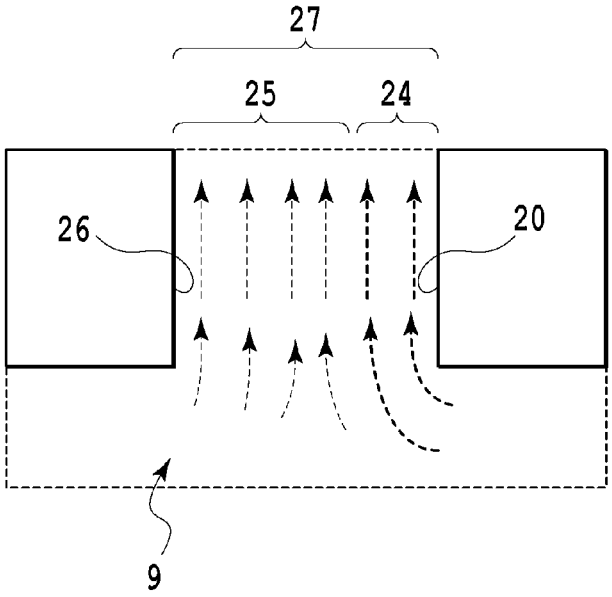
FIG. 4B is an enlarged explanatory view illustrating an air current around a suction port of the mist collecting mechanism.

FIGS. 4A and 4B illustrate explanatory views for illustrating the flow of the air and mist around the mist collecting mechanism 2 when the mist is collected by the mist collecting mechanism 2 of the present embodiment.

FIG. 4A illustrates the flow of the air and mist in the space between the liquid ejection head 1 (not shown in FIG. 4A. The printing head 1 is arranged on the right side of the mist collecting mechanism 2 in FIG. 4A) as well as the mist collecting mechanism 2 and the printing medium 3. In FIG. 4A, the flow of air containing a mist 16 is indicated by lines. Of the blow-out ports 10, the first blow-out port 17 arranged on the downstream side in the conveying direction of the printing medium performs a relatively strong blowing-out of air. The air current, which is blown out downward from the first blow-out port 17 toward the surface of the printing medium 3, is once reflected by the printing medium 3 on the platen and then is rolled upward. A part of the air, which is reflected by the printing medium 3 and rolled up, flows toward the suction port 9. In this manner, the first blow-out port 17 blows out an air toward the platen 36 or the printing medium on the platen 36, and the suction port 9 sucks the air that is blown out from the first blow-out port 17 and reflected by the platen 36 or the printing medium on the platen 36.

Together with the air sucked by the suction port 9, the mists floating in the area between the liquid ejection head 1 and the printing medium 3 are sucked by the suction port 9. Thus, the mists present in the area between the liquid ejection head 1 and the printing medium 3 are collected by the mist collecting mechanism 2.

At this time, the blowing-out is performed not only by the first blow-out port 17 but by the second blow-out port 21 arranged on the upstream side of the suction port 9. The air current generated by the blowing-out from the second blow-out port 21, because it has a relatively small flow rate as compared with the air current generated by the blowing-out from the first blow-out port 17, is not reflected by the printing medium but is attracted to the suction by the suction port 9 and flows toward the suction port 9. Because not only an air current due to the blowing-out from the first blow-out port 17 but an air current by the blowing-out from the second blow-out port 21 flows toward the suction port 9, a part of the air current by the blowing-out from the first blow-out port 17 is pushed to the downstream side in the conveying direction.

In collecting the mist, because the mist 16 in the vicinity of the printing medium 3 is pulled up to the suction port 9, an air current 18 by the first blow-out port 17 once reaches the vicinity of the printing medium 3 and is then pulled up to the suction port 9. Accordingly, in performing blowing-out from the first blow-out port 17, the air of a flow rate sufficient for the air current by the blowing-out to be pulled up to the vicinity of the suction port 9 needs to be blown out. Therefore, upon reaching the suction port 9, the air current 18 by the blowing-out from the first blow-out port 17 may cause the air flow, which the suction port 9 sucks from the space between the printing medium and the collecting mechanism 2, to deviate to a side wall 20 on the upstream side of the inside of the suction port 9. Therefore, the mist generated on the upstream side of the mist collecting mechanism 2 tends to position deviated to the side wall 20 of the upstream side of the suction port 9 and adhere to the wall surface of the side wall 20 of the suction port 9. In this embodiment, the second blow-out port 21 is provided on the upstream side of the suction port 9. By blowing out air from the second blow-out port 21, a layer of air current is formed at a position near the side wall 20 being inside of the suction port 9. In this manner, by generating an air current 22 by the blowing-out from the second blow-out port 21, the deviation of the mist toward the side wall 20 on the upstream side in inside of the suction port 9 can be suppressed by the air current sucked from the suction port 9. Thus, the amount of adhesion of the mist adhering to the side wall being inside of the suction port 9 is reduced.

FIG. 4B illustrates an enlarged cross sectional view of the air current at this time in the suction port 9. As illustrated in FIG. 4B, not only the air current by the blowing-out from the first blow-out port 17 but the air current by the blowing-out from the second blow-out port 21 are guided to the suction port 9. The air current by the blowing-out from the second blow-out port 21 is sucked into the suction port 9, so that the air current by the blowing-out from the first blow-out port 17 is pushed to the downstream side in the conveying direction of the printing medium. Moreover, depending on the flow rate of the air blown out from the second blow-out port 21, the position, toward which an air current that is rolled up after the blowing-out from the first blow-out port 17 flows, varies. In this manner, by adjusting the flow rate of the air blown out from the second blow-out port 21, the position, toward which the air blown out from the first blow-out port 17 flows, is adjusted. Here, the blowing-out from the second blow-out port 21 is performed so that the air current by the blowing-out from the first blow-out port 17 flows toward a position close to the center of the suction port 9. That is, the position, toward which the air current by the blowing-out from the first blow-out port 17 flows, can be controlled by the blowing-out from the second blow-out port 21.

In this manner, with the blowing-out from the second blow-out port 21, the air current by the blowing-out from the first blow-out port 17 can be positioned at a position close to the center of the suction port 9. Accordingly, the air current can be efficiently sucked by the suction port 9 and the mist can be collected with a high degree of accuracy and efficiently. Moreover, in a case where the flow rate of the air current by the blowing-out from the second blow-out port 21 is high, the direction, toward which the air current by the blowing-out from the first blow-out port 17 flows, is shifted to the further downstream side in the conveying direction. In this manner, by adjusting the flow rate of the air blown out from the second blow-out port 21, the position, toward which the air current by the blowing-out from the first blow-out port 17 flows, can be adjusted. Accordingly, the position, toward which the air current by the blowing-out from the first blow-out port 17 flows, can be easily controlled.

The flow rate of the air current that is blown out at this time from the second blow-out port 21 is described. As illustrated in FIG. 4B, an air current 22 blown out from the second blow-out port 21 is sucked along the side wall of the suction port 9, and flows together with a rolled-up portion of the air current, which is generated by the blowing-out from the first blow-out port 17, and forms a layer of air flow inside the suction port 9. In a case where the flow rate of an air current 24 from the second blow-out port 21 is too high, the rolled-up portion of an air current 25 is pushed toward the side wall 26 on the downstream side opposite to the side wall 20 on the upstream side. Accordingly, in a case where the flow rate of the air current blown out from the second blow-out port 21 is excessively high, the possibility that the mist adheres to the side wall 26 on the downstream side in the suction port 9 increases. Therefore, the flow rate of the air current from the second blow-out port 21 is desirably high enough for the air current 25 of the rolled-up portion not to be driven toward the side wall 26 on the downstream side. In the embodiment, the flow rate of the air blown out from the second blow-out port 21 is desirably equal to or less than half a suction flow rate 27 of the suction port 9.

Figure 5:
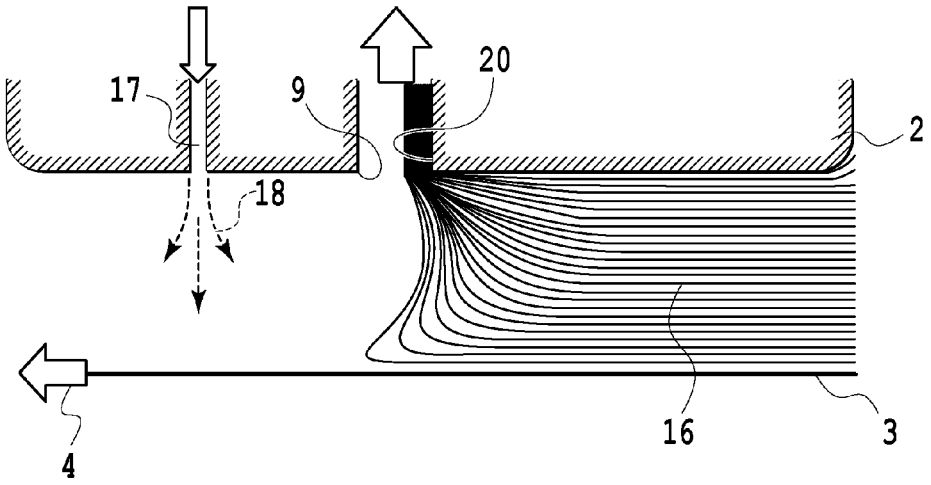
FIG. 5 is an explanatory view for illustrating the air current around a mist collecting mechanism of a comparative example.

Next, as a comparative example, the collection of mists in a case where there is no blowing-out from the second blow-out port 21 is described. FIG. 5 illustrates an explanatory view for illustrating an air flow between the mist collecting mechanism 2 and the printing medium in the case where there is no blowing-out by the second blow-out port 21. Here, because there is no blowing-out by the second blow-out port 21, in a case where the blown-out air by the first blow-out port 17 is once sprayed toward the printing medium and then reflected by the printing medium and rolled up, the direction toward which the air current flows deviates to the upstream side in the conveying direction.

In the comparative example illustrated in FIG. 5, the air current by the blowing-out by the first blow-out port 17 is sucked in a state deviated toward a position close to the wall surface in upstream side in inside of the suction port 9. In a case where the air current containing mists is sucked by the suction port 9 in this state, the suction of the air current is performed at upstream side of the suction port 9 mainly. Accordingly, the amount of mists sucked by the suction port 9 is restricted. Therefore, the efficiency of collection of mists may degrade.

Moreover, in a case where the air current by the blowing-out by the first blow-out port 17 is sucked in the state deviated toward a position close to the wall surface of the side wall 20 inside of the suction port 9, a relatively large amount of mists adheres to the wall surface of the side wall 20 of the suction port 9. An excessively increased amount of mists adhering to the wall surface of the side wall 20 in the suction port 9 would result in a puddle of liquid, which might drop on the printing medium and degrade the quality of the printing image. Moreover, in a case where a large amount of mists adheres to the wall surface of the side wall 20 in the suction port 9 and results in a puddle of liquid and in this state a printing medium having a curl or the like contacts a region near the suction port 9 in the mist collecting mechanism 2, the ink may adhere to the printing medium. This may further decrease the quality of the printing image.

Next, the positions of the suction port 9 and the first blow-out port 17 are described. The first blow-out port 17 blows out air at a relatively high flow rate in order to roll up the mist 16. In a case where a blown-out air flow 18 reaches the printing medium 3 and reflects there, the downwardly blown-out air current changes its direction and is rolled upward. This rolled-up air current is attracted and sucked by the suction port 9 and thereby the mist 16 is guided to the suction port 9.

Here, in a case where the distance between the first blow-out port 17 and the suction port 9 is short, a rolled-up portion of the air current blown out by the first blow-out port 17 will position on the upstream side of the suction port 9. In this case, the air current containing the mist 16 flows upward at a position deviating to the upstream side of the suction port 9 and collides with the wall surface of the mist collecting mechanism 2 at a position deviating to the upstream side of the suction port 9. Therefore, the suction amount of the air current containing the mist 16 by the suction port 9 can be minimized. Moreover, in this case, because particularly the air current containing the mist 16 flows upwardly and collides with the wall surface of the mist collecting mechanism 2 at a position deviating to the upstream side of the suction port 9, the air current cannot approach the suction port 9 anymore due to the rolled-up air current. Accordingly, the air current containing the mist is blocked at a position on the upstream side of the suction port 9 and it is therefore difficult to collect the mist by sucking the air current containing the mist by the suction port 9.

Then, first, the blowing-out from the first blow-out port 17 is desirably set so that an ascending air current portion of the rolled-up portion of the air current blown out by the first blow-out port 17 is present on the downstream side of the suction port 9. Here, the path of an air current in a case where the air current generated by the blowing-out from the first blow-out port 17 is rolled-up is assumed to be circular. In this case, the distance between a position of the blowing-out by the first blow-out port 17 and a position of the ascending portion of an air current in a case where the air current is rolled-up is approximately equal to the diameter of this circle. The diameter of the rolling-up air current generated at this time is on the order of the distance between the mist collecting mechanism 2 and the printing medium 3. Accordingly, in order for the rolled-up portion of the air current due to the blowing-out from the first blow-out port 17 to be present on the downstream side of the suction port 9, the distance between the first blow-out port 17 and the suction port 9 is desirably equal to or greater than the distance (clearance) between the mist collecting mechanism 2 and the printing medium 3. In this manner, in the embodiment, the distance between the first blow-out port 17 and the suction port 9 is desirably equal to or greater than the distance (clearance) between the suction port 9 of the mist collecting mechanism 2 and the printing medium 3.

Because the liquid ejection head 1 and the mist collecting mechanism 2 of the liquid ejection apparatus 100 of the present embodiment are constituted as described above, the mist around the liquid ejection head 1 is efficiently collected. Therefore, printing can be performed by the liquid ejection head 1 in an environment where the periphery of the liquid ejection head 1 is kept clean. Accordingly, a decrease in the quality of the printing image due to mists and a puddle of ink formed by accumulation of mists adhering to the printing medium in printing can be suppressed. Accordingly, a quality of a print image obtained by printing can be maintained high. Moreover, a puddle of ink resulting from mists adhering to a part of the liquid ejection apparatus can be suppressed. Accordingly, even in a case where a printing medium deformed due to curl or the like is conveyed to the position corresponding to the liquid ejection head and this printing medium contacts a part of the liquid ejection apparatus 100, adhesion of ink to the printing medium can be suppressed. Accordingly, the quality of the print image is maintained high. Moreover, because the collection of mists by the mist collecting mechanism 2 can be efficiently performed, the amount of mists floating around the liquid ejection apparatus 100 can be minimized. Accordingly, the use environment of the liquid ejection apparatus 100 of a user can be improved.

Moreover, because the collection of mists can be efficiently performed, the extent of suction by the suction mechanism of the mist collecting mechanism 2 can be reduced. Accordingly, the output power of a driving source for conducting suction can be reduced. Thus, the liquid ejection apparatus 100 can be miniaturized. Moreover, because the driving source for conducting suction just needs a low output power, the manufacturing cost of the liquid ejection apparatus can be minimized. Moreover, because the suction of mists by the mist collecting mechanism can be efficiently performed, the opening areas of the suction unit and the blow-out unit can be minimized. Accordingly, the liquid ejection apparatus 100 can be further miniaturized.

Note that, in the present embodiment, the liquid ejection apparatus according to the present invention is described in the case where the liquid ejection apparatus is applied to the so-called full-line type liquid ejection apparatus wherein printing is performed by the fixed liquid ejection head 1. However, the present invention may be applied to a serial scan type liquid ejection apparatus wherein the liquid ejection head performs printing while scanning. Also in this case, the present invention may be applied to a liquid ejection apparatus wherein the mist collecting mechanism is arranged on the downstream side in the conveying direction of the printing medium. In this case, the liquid ejection head and the mist collecting mechanism are preferably mounted on the same carriage so that the mist collecting mechanism does not relatively move with respect to the liquid ejection head.

Moreover, the present invention may be applied to the case where the liquid ejection apparatus is a serial scan type liquid ejection apparatus, wherein printing is performed while scanning a liquid ejection head and printing is performed by only one of scans in the reciprocation movement of a carriage. In this case, the effect on mists from an air current generated by a relative movement between the liquid ejection head and the printing medium in printing is constant. Therefore, the mists can be efficiently sucked by the suction port by applying the present invention. In this case, the mist collecting mechanism is arranged at a position on the downstream side of the liquid ejection head in the scanning direction, along which printing is performed.

Second Embodiment

Next, a liquid ejection apparatus according to a second embodiment is described with reference to FIG. 6. Note that a portion that is constituted similarly to the first embodiment is marked with the same reference numeral in the view and the description thereof is omitted and only a different portion is described.

Figure 6:
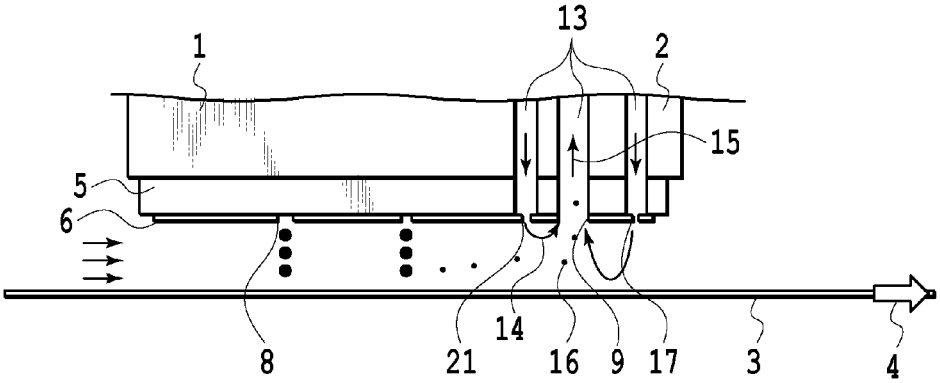
FIG. 6 is an enlarged cross sectional view schematically illustrating the main portion of a liquid ejection head and mist collecting mechanism used for a liquid ejection apparatus according to a second embodiment of the present invention.

FIG. 6 illustrates a schematic cross sectional view of a periphery of the liquid ejection head 1 and the mist collecting mechanism 2 of the liquid ejection apparatus in the second embodiment. In the liquid ejection apparatus of the first embodiment, the mist collecting mechanism 2 is constituted as a separate body from the liquid ejection head 1. Moreover, the mist collecting mechanism 2 is installed on the downstream side of the liquid ejection head 1 in the conveying direction. In contrast, in the second embodiment, as illustrated in FIG. 6, the suction port 9, the first blow-out port 17, and the second blow-out port 21 are formed in a member constituting the liquid ejection head. That is, in the second embodiment, the liquid ejection head 1 and the mist collecting mechanism 2 are integrally formed.

Specifically, the ejection port 8 is formed on the orifice member 6, and the duct 13 in the mist collecting mechanism 2 is formed inside the support member 5 of the orifice member 6. Moreover, a non-illustrated air suction mechanism and the air blow-out mechanism are connected to the liquid ejection head 1. The liquid ejection head 1 and the mist collecting mechanism 2 are constituted in this manner, so that the distance between the ejection port array 7 and the mist collecting mechanism 2 can be reduced and the liquid ejection apparatus can be miniaturized. Moreover, the distance between the liquid ejection head 1 and the mist collecting mechanism 2 is formed short, and therefore when the mist 16 is generated, the mist can be collected before the mist is diffused around.

Accordingly, the suction force by the mist collecting mechanism 2 can be suppressed, so the power consumption of the mist collecting mechanism 2 can be minimized. Moreover, because the opening areas of the suction port and the blow-out port in the mist collecting mechanism 2 can be reduced, the mist collecting mechanism can be miniaturized and furthermore the liquid ejection apparatus can be miniaturized. Moreover, because the liquid ejection apparatus can be miniaturized, the manufacturing cost of the liquid ejection apparatus can be minimized.

Third Embodiment

Next, a liquid ejection apparatus according to a third embodiment is described with reference to FIGS. 7A and 7B. Note that a portion that is constituted similarly to the first embodiment and the second embodiment is marked with the same reference numeral in the view and the description thereof is omitted and only a different portion is described.

Figure 7A:
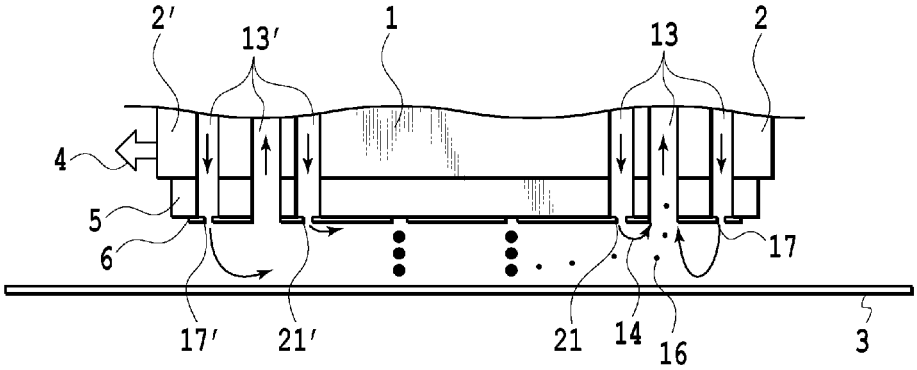
Figure 7B:
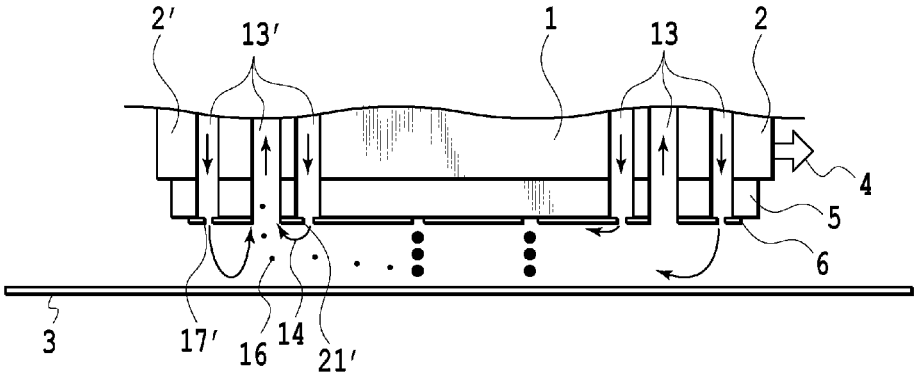

FIGS. 7A and 7B illustrate schematic cross sectional views of a liquid ejection head and a mist collecting mechanism of the liquid ejection apparatus according to the third embodiment of the present invention. In the liquid ejection apparatus of the first embodiment and the second embodiment, a form has been described, in which the mist collecting mechanism is attached to the full-line type liquid ejection apparatus that uses the liquid ejection head extending across the whole region in the width direction of the printing medium. Moreover, a form also has been described, in which the mist collecting mechanism is attached to the serial scan type liquid ejection apparatus, wherein the liquid ejection head performs printing while scanning and the printing is performed by only one of scans in the reciprocation movements of a carriage. In the third embodiment, a form is described, in which the mist collecting mechanism is attached to a serial scan type liquid ejection apparatus, wherein the liquid ejection head performs printing while scanning and the printing is performed by scanning in the both reciprocation directions of the reciprocation movement of a carriage.

As illustrated in FIGS. 7A and 7B, in the liquid ejection apparatus of the present embodiment, the liquid ejection head 1 can reciprocate relative to the printing medium 3 and perform printing in both directions. In the embodiment, in order to correspond to the printing by scanning in the both directions of the reciprocal scan in the liquid ejection head 1, the mist collecting mechanism 2 and a mist collecting mechanism 2' are attached to the both outsides, along the main scanning direction along which scanning is performed, of the liquid ejection head 1. Thus, the collection of mists can be performed in both the forward scanning and the backward scanning in bidirectional printing.

FIG. 7A illustrates a schematic cross sectional view of the periphery of the liquid ejection head 1 and the mist collecting mechanisms 2 and 2' in a state where mists are collected by the mist collecting mechanism. 2 while scanning is performed in one of the forward scanning and the backward scanning of bidirectional printing. Moreover, FIG. 7B illustrates a schematic cross sectional view of the periphery of the liquid ejection head 1 and the mist collecting mechanisms 2 and 2' in a state where mists are collected by the mist collecting mechanism 2' while scanning is performed in the direction opposite to the direction of FIG. 7A.

In both FIGS. 7A and 7B, the collection of mists is performed by the mist collecting mechanisms 2 and 2' on the downstream side in a direction along which scanning is performed. Also because the liquid ejection head 1 and the mist collecting mechanisms 2 and 2' are constituted in this manner, the collection of mists can be performed by the mist collecting mechanisms 2 and 2' in both the forward scanning and the backward scanning in bidirectional printing. Accordingly, also when bidirectional printing is performed, printing can be performed while the mist 16 is efficiently collected. Accordingly, printing can be performed by the liquid ejection head 1 in an environment where the periphery of the liquid ejection head 1 is kept clean, and a high-quality print image can be provided by printing. In the present embodiment, an example that not only the mist collecting mechanism arranged at downstream side of the relative movement direction between the liquid ejection head 1 and the printing medium 3, but also the mist collecting mechanism arranged at upstream side of the relative movement direction is operated has been explained. In this manner, the mist collecting mechanism arranged at upstream side of the liquid ejection head 1 may also be driven. However, the mist collecting mechanisms 2 and 2' may be controlled as operated mist collecting mechanism being switched so that the mist collecting mechanism arranged at downstream side of the relative movement direction is operated.

Fourth Embodiment

Next, a liquid ejection apparatus according to a fourth embodiment is described with reference to FIG. 8. Note that a portion that is constituted similarly to the first embodiment to the third embodiment is marked with the same reference numeral in the view and the description thereof is omitted and only a different portion is described.

Figure 8:
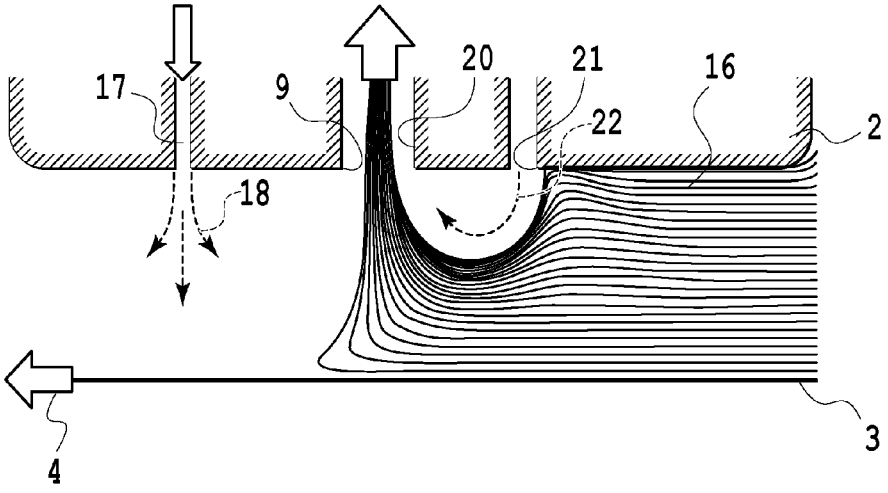
FIG. 8 is an explanatory view for illustrating the air current around a mist collecting mechanism according to a fourth embodiment of the present invention.

FIG. 8 illustrates a schematic cross sectional view of a periphery of the mist collecting mechanism. 2 of the liquid ejection apparatus in the fourth embodiment. Also in this embodiment, the liquid ejection head 1 is arranged on the right side of the mist collecting mechanism 2. In the liquid ejection apparatus of the fourth embodiment, the opening of the other end side of the second blow-out port 21 communicates with the atmospheric air. A blowing mechanism, such as a pump, for forcibly blowing out air is not connected to the liquid ejection apparatus. In the present embodiment, an external air is pulled into a duct being communication with the second blow-out port 21 from the opening of the other end side by the suction of air from the suction port 9 and pressure difference generated by relative movement between the liquid ejection head 1 and the printing medium 3. The flow of mists is changed because this external air is discharged from the second blow-out port 21 and flows toward the suction port 9.

As described above, since an amount of blowing-out blown out from the second blow-out port 21 may be relatively small amount, there is a merit that a blowing mechanism, such as a blowing fan, does not need to be provided in the second blow-out port 21 and the printing apparatus can be made more compact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2013-195868, filed Sep. 20, 2013, and 2014-156659, filed Jul. 31, 2014, which are hereby incorporated by reference herein in their entirety.

What is claimed is:

1. A liquid ejection apparatus comprising a liquid ejection head having an ejection port array, in which ejection ports configured to eject liquid are arranged in a predetermined direction, the liquid ejection apparatus applying the liquid ejected from the ejection ports to a medium, the liquid ejection apparatus further comprising:

a first blow-out port configured to blow out air toward the medium;

a suction port configured to suck air containing mists that are generated by ejection of the liquid from the ejection ports; and a second blow-out port configured to blow out air toward the medium, wherein the ejection port array, the second blow-out port, the suction port, and the first blow-out port are arranged in this order from an upstream side toward a downstream side in a movement direction of the medium, and wherein a flow rate of the air blown out from the second blow-out port is less than a flow rate of the air blown out from the first blow-out port.

2. The liquid ejection apparatus of claim 1, wherein the second blow-out port, the suction port, and the first blow-out port extend in the predetermined direction.

3. The liquid ejection apparatus of claim 2, wherein the ejection port array, the second blow-out port, the suction port, and the first blow-out port are arranged in parallel with respect to a direction perpendicular to the predetermined direction.

4. The liquid ejection apparatus of claim 2, wherein a length in the predetermined direction of each of the second blow-out port, the suction port, and the first blow-out port is longer than a length in the predetermined direction of the ejection port array.

5. The liquid ejection apparatus of claim 1, wherein the first blow-out port blows out the air toward the medium, and the suction port sucks the air that is blown out from the first blow-out port and reflected by the medium.

6. The liquid ejection apparatus of claim 1, wherein the second blow-out port blows out the air toward the medium, and the blown-out air is sucked from the suction port without reaching the medium.

7. The liquid ejection apparatus of claim 1, wherein a flow rate of the air blown out from the second blow-out port is equal to or less than half a flow rate of the air sucked by the suction port.

8. The liquid ejection apparatus of claim 1, wherein a distance between the suction port and the first blow-out port is equal to or greater than a distance between the suction port and the medium.

* * * * *